United States Patent [19]

Williams

[11] 4,070,869

[45] Jan. 31, 1978

[54] METHOD OF GROUTING OFFSHORE STRUCTURE

[76] Inventor: Kenneth Anthony Williams, 3525 N. Causeway, Metaire, La. 70002

[21] Appl. No.: 768,165

[22] Filed: Feb. 14, 1977

[51] Int. Cl.[2] ..... E02D 21/00

[52] U.S. Cl. ..... 61/100

[58] Field of Search ..... 61/99, 98, 97, 96, 100, 61/94, 89, 92, 90, 87, 88, 63, 54

[56] References Cited

U.S. PATENT DOCUMENTS

| | | | |
|---|---|---|---|
| 1,256,074 | 2/1918 | Taft | 61/63 |
| 3,839,872 | 10/1974 | Loire | 61/98 |
| 3,857,247 | 12/1974 | Phares | 61/94 |

*Primary Examiner*—Jacob Shapiro

[57] ABSTRACT

A method of grouting an offshore structure such as the leg of an offshore platform having an outer tubular jacket and an inner tubular piling wherein grout is deposited in the annulus therebetween. The method includes introducing a tube downwardly through the annular space until the lower end of the tube is proximate the bottom of the annular space. Thereafter grout is circulated down the tubing and up the annulus to thereby displace water from the annulus and fill the same with a column of grout. Preferably, the tube is removed from the annulus before the grout hardens.

In certain instances, it may be required to form a plug in the bottom of the annulus to establish circulation through the tube, up the annulus, and out at the top.

In order to form such a plug, a quantity of plug forming material, such as a liquid epoxy resin composition or a quick-setting cement slurry is circulated down the tube to the bottom of the annular space and there deposited. The tube is then raised until the lower end thereof is above and proximate to the upper surface of the deposited plug forming material, which material is then allowed to harden to form a plug in the annulus. The plug forming material is of a type which is relatively quick setting compared with the grout.

4 Claims, 3 Drawing Figures

METHOD OF GROUTING OFFSHORE STRUCTURE

BACKGROUND OF THE INVENTION a. Field of the Invention

This invention relates to a method of grouting an offshore structure such as the leg of an offshore drilling platform having an outer tubular jacket and an inner tubular pile wherein grout is deposited between the two.

b. Description of the Prior Art

When installing offshore structures such as offshore platforms, it is the usual custom to install relatively large tubular jackets in a generally vertical position at the offshore location, which jackets extend downwardly to and perhaps into the sea bed a short distance and extend upwardly above the surface of the water. Such jackets provide guide means through which a tubular pile is thereafter inserted and driven downwardly therethrough. The result is that there is then formed an annular space between the inside of the tubular jacket and the outside of the tubular pile. This annular space must be grouted in order to form a rigid structure or leg. Various methods and apparatus have been devised in the past for accomplishing this grouting operation, none of which are fully satisfactory for various reasons. The following patents are generally illustrative of the prior art:

U.S. Pat. No. 2,653,451

U.S. Pat. No. 2,933,898

U.S. Pat. No. 3,564,856

The present invention constitutes an improvement over the prior art in several respects. The method of this invention is carrier out without the need or requirement for the use of mechanical packers in the bottom of the jacket and without the need for external grout lines thereby eliminating the need for any divers. Further, there is no air entrapped in the deposited grout thereby giving better compression strength to the column of grout once the same is set up. Also, the annular space is filled from the bottom upwardly so that there is no chance of bridging as would be the case with grout being deposited by gravity through the annulus.

SUMMARY OF THE INVENTION

It is therefore an object of this invention to provide an improved method of grouting an offshore structure of the aforesaid type.

Briefly stated, this invention is for a method of grouting an offshore structure having a generally vertically extending outer jacket which extends upwardly from the sea bed and with a pile mounted inside the same, with the pile being of a smaller diameter than the inside diemater of the jacket to form an annular space therebetween. The invention includes the combination of steps of introducing a conduit means such as a tubing downwardly through the annular space until the lower end of the tubing is proximate the bottom of the annular space which is to be grouted. Thereafter, grout material is circulated down the tubing and up the annulus to thereby displace water from the annulus and fill the annulus with a column of grout. Once the column is filled with grout, the tubing may be removed from the annulus before the grout hardens. In certain circumstances, it may be necessary to form a plug in the bottom of the annulus to establish circulation through the tube, up the annulus; and out at the top. In such instances, a quantity of plug forming material, such as a liquid epoxy resin composition or a quick-setting cement slurry is circulated through the tubing to the bottom of the annular space and there deposited. The tubing is then raised until the lower end thereof is above and proximate the upper surface of the deposited plug material. The deposited plug material is then allowed to harden to thereby form a plug in the annulus. It is to be understood that the plug forming material is relatively quick setting as compared with the grout.

DESCRIPTION OF THE PREFERRED EMBODIMENT

Figure 1:
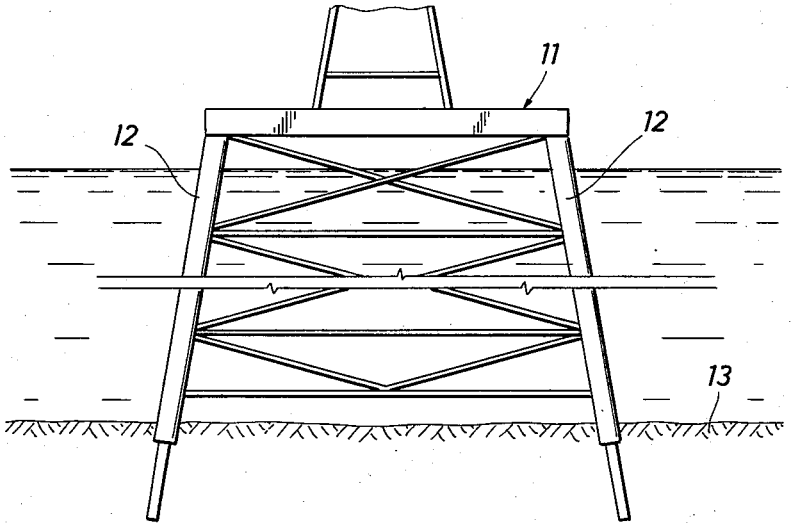
FIG. 1 is a side elevation view of a typical offshore platform having legs of the type to which the present invention is applicable.
Figure 2:
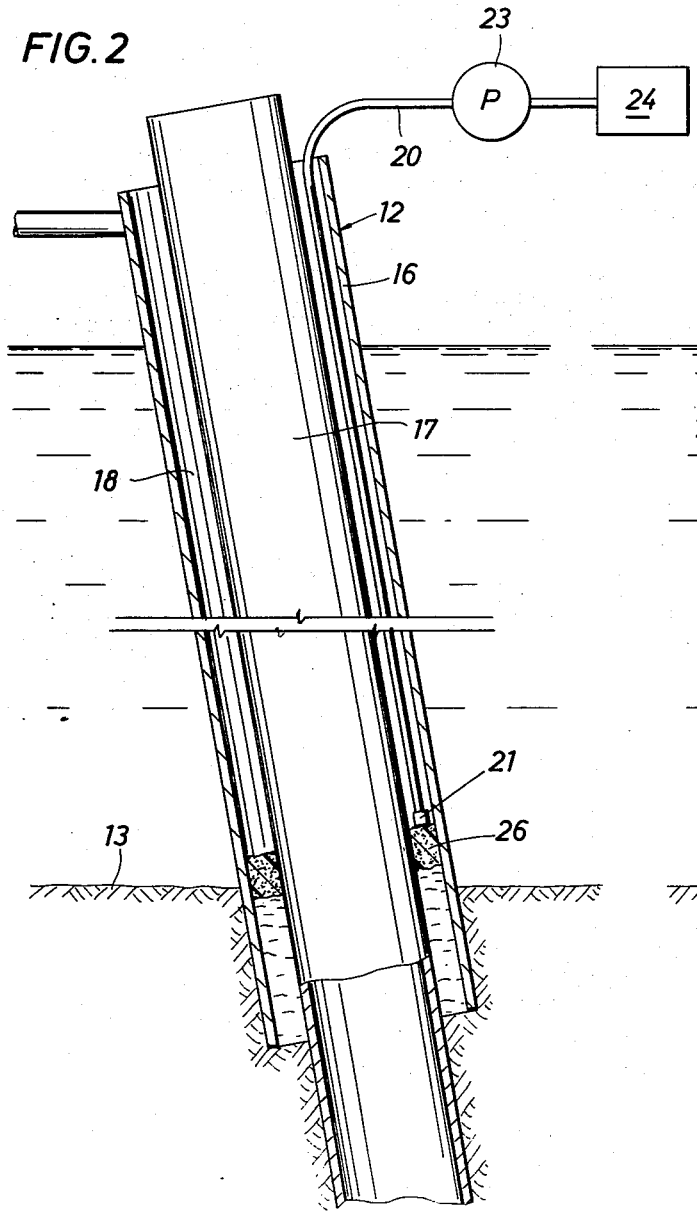
FIG. 2 is a cross sectional view of an outside tubular jacket of a leg of a structure of the type shown in FIG. 1 showing a tubular pile inserted therein and with the plug material shown being deposited at the bottom of the annular space which is to be grouted.

Referring now to the drawing, the numeral 11 generally shows an offshore structure having a plurality of legs 12 of the type to which the present invention is applicable, which legs are generally shown extending into sea bed 13. Referring now to FIG. 2, legs 12 are usually comprised of an outer tubular Jacket 16 which is of a relatively large diameter and which extends downwardly through sea bed 13 a short distance and usually upwardly to above the water surface. Jacket 16 generally serves as a guide for a pile such as tubular pile 17 which is driven downwardly therethrough to a greater depth into sea bed 13 so as to reach a firmer foundation supporting area than is true with respect to jacket 16. Once tubular pile 17 has been driven to the desired depth, it is thereafter necessary to grout the annular space 18 with grout to thereby provide a rigid structure which can withstand the compressive forces of the offshore platform and the lateral forces exerted by wave action, current action and the like. It is therefore necessary to use a grout which will withstand great compressive forces, which grouting materials are generally well known to those skilled in the art. However, such grouting materials are generally not of the quick-setting type and in prior art methods various systems were developed to deposit such grout and maintain the same until it became hardened to the desired degree and which was free of entrapped air or water and the like.

Accordingly, the present invention contemplates inserting downwardly through annular space 18 small conduit means in the form of small tubing 20 on the order of ½ inch in diameter or the like. Tubing 20 is lowered in annular space 18 until the lower end 21 thereof is proximate the bottom portion of annular space 18 which is to be grouted. Tubing 20 is shown connected to pump 23 and a conventional mixer 24.

With tube 20 positioned as shown in FIG. 2, grout is then flowed downwardly therethrough, whereby grout is deposited in annulus 18. This pumping is continued with the result that the grout accumulates in the bottom of annulus 18 and continues to build up, lifting and displacing any water thereabove. This step of pumping of grout is continued until annulus 18 is sufficiently full and water displaced therefrom to provide the structure with the desired rigidity when the grout hardens. Preferably tube 20 is removed from annulus 18 after the aforesaid deposition step and before the grout becomes set up, which would prevent such removal. Hence, tube 20 may be reused on subsequent grouting operations.

In certain instances, it may be difficult to establish circulation of the grout down tube 20 and up annulus 18 as described for the reason that the hydrostatic head created by the column of grout may cause loss of circulation out the bottom of the annulus. When such occurs, it is desirable to form an insitu plug in the bottom of the annulus, which step will now be described.

With tubing 20 positioned as shown in FIG. 2, a relatively quick setting plug forming material is mixed in mixture 24, (if mixing is required) and thereafter pumped by pump 23 downwardly through tubing 20 and deposited in the lower portion of annular space 18 which is to be grouted, which pumping is continued until a quantity of the plug forming material is deposited, which quantity upon hardening will form a plug such as plug 26. Once the desired quantity of plug forming material has been deposited, the lower end 21 of tubing 20 is raised until the same is generally adjacent the upper surface of plug 26 as shown in FIG. 3.

The plug forming material is thereafter allowed to harden until the aforesaid plug 26 is formed. It is to be understood that plug 26 may be formed of any relatively quick-setting material such as a liquid epoxy resin composition that solidifies following its placement, or a quick-setting cement slurring. Plug 26 need not be of the type which will harden to the point that it will withstand compressive forces to the extent that hardened grout will, but it should be sufficiently quick setting to a sufficient hardness so that the same will not be washed from the plug forming position by the subsequent grouting step.

Figure 3:
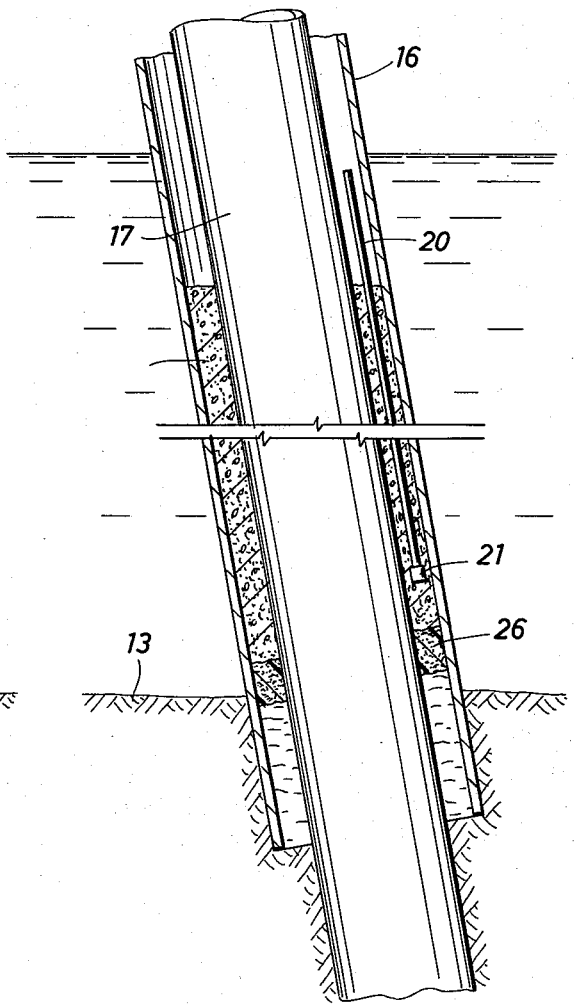
FIG. 3 is a view similar to FIG. 2 but showing the plug in place and with the grout being flowed downwardly through the tube and upwardly through the annulus.

Once plug 26 has been allowed to harden to the aforesaid hardness, and tubing 20 raised to the position shown in FIG. 3, the grouting operation as described above is then carried out and grout is pumped downwardly through tubing 20 and out lower end 21 thereof. Pumping of such grout is continued with the result that grout is deposited in the annulus immediately above 26 and displaces water upwardly therefrom in annular space 18. Sufficient grout is pumped down tubing 20 and up annular space 18 until grout column 28 is formed in annular space 18 to the desired height and with water displaced therefrom. Thereafter, tubing 20 may be removed from annular space and the grout allowed to harden, thus completing the grouting operation.

The aforesaid steps may then be repeated on other legs of offshore platform 11. It is to be understood that the grout may be of any conventional type, as for example an aqueous slurry including 50% Portland cement and 50% fly ash.

The aforesaid method has many advantages over conventional air pressure grouting. For example, annular space 18 is filled from the bottom so that there is no chance of bridging as is the case with grout material being deposited through the annulus from the top. The present invention insures that there is no air or water entrapped in the grout thereby giving better compression strength to the offshore structure.

The aforesaid method requires no external grout lines and therefore no divers are required for carrying out the process. Further, no mechanical packers are required at the bottom of the jacket thereby reducing the cost for performing the grouting operation.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiments. Various changes may be in the shape, size and arrangements of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. In a method of grouting an offshore structure having a generally vertically extending outer jacket extending upwardly from the sea bed and a pile mounted inside said jacket, said pile being of a smaller outside diameter than the inside diameter of said jacket to form an annular space therebetween, the combination of steps comprising:

introducing a tube having an outside diameter smaller than the radial thickness of said annulus space downwardly through said annular space until the lower end of said tube is proximate the bottom portion of said annular space which is to be grouted;

and pumping grout down said tube and up said annular space to thereby displace water from said annulus and fill said annulus with a column of grout.

2. The invention as claimed in claim 1 including:

removing said tube from said annulus space before said grout hardens.

3. In a method of grouting an offshore structure having a generally vertically extending outer jacket extending upwardly from the sea bed and a pile mounted inside said jacket, said piling being of a smaller outside diameter than the inside diameter of said jacket to form an annular space therebetween, the combination of steps comprising:

introducing conduit means downwardly through said annular space until the lower end of said conduit means is proximate the bottom portion of said annular space which is to be grouted;

circulating a quantity of a plug forming material through said conduit to said bottom portion of said annular space;

raising said conduit means until the lower end thereof is above and proximate the upper surface of said deposited plug forming material;

allowing said plug forming material to harden to thereby form a plug in said annulus;

and circulating grout down said conduit means and up said annulus to thereby displace water from said annulus and fill said annulus with a column of grout.

4. The invention as claimed in claim 1 wherein:

said plug forming material is relatively quick setting as compared with said grout.

* * * * *

UNITED STATES PATENT AND TRADEMARK OFFICE

CERTIFICATE OF CORRECTION

PATENT NO. : 4,070,869

DATED : January 31, 1978

INVENTOR(S) : Kenneth Anthony Williams

It is certified that error appears in the above-identified patent and that said Letters Patent are hereby corrected as shown below:

In column 1, line 35 "carrier" should read --carried--; line 55 "diemater" should read --diameter--. In column 3, line 17 "mixture" should read --mixer--; line 32 "slurring" should read --slurry--. In column 4, line 30 "annulus" should read --annular--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*